US005319418A

United States Patent [19]

Fujimoto et al.

[11] Patent Number: 5,319,418

[45] Date of Patent: Jun. 7, 1994

[54] IMAGE FORMING APPARATUS

[75] Inventors: Tetsuya Fujimoto, Kawasaki; Hiroshi Kishimoto, Himeji; Tomohiro Nonomura, Takasago, all of Japan

[73] Assignee: Fujitsu Limited, Kawasaki, Japan

[21] Appl. No.: 965,051

[22] Filed: Oct. 22, 1992

Related U.S. Application Data

[63] Continuation of Ser. No. 870,775, Apr. 21, 1992, abandoned, which is a continuation of Ser. No. 582,208, filed as PCT/JP90/00619, May 16, 1990, abandoned.

[30] Foreign Application Priority Data

May 19, 1989 [JP] Japan ..... 1-127197

[51] Int. Cl.[5] ..... G03G 15/00

[52] U.S. Cl. ..... 355/200; 74/417; 74/665 GC; 355/210

[58] Field of Search ..... 355/245, 210, 200, 211; 74/417, 423, 665 GB, 665 GC

[56] References Cited

U.S. PATENT DOCUMENTS

| | | | |
|---|---|---|---|
| 2,947,201 | 8/1960 | Lofburg | 74/665 GC |
| 3,408,954 | 11/1968 | Kademann et al. | 74/665 GC |
| 3,888,138 | 6/1975 | Hiersig | 74/665 GC X |
| 4,760,753 | 8/1988 | Vetter | 74/417 X |
| 4,851,873 | 7/1989 | Sakao et al. | 355/245 |
| 4,860,049 | 8/1989 | Toshimitsu et al. | 355/245 X |

FOREIGN PATENT DOCUMENTS

| | | |
|---|---|---|
| 62-280866 | 12/1987 | Japan . |
| 1-120458 | 5/1989 | Japan . |

OTHER PUBLICATIONS

*Patent Abstracts of Japan*, vol. 8, No. 202 (P-300), Sep. 14, 1984 (JP 59-087464).

*Patent Abstracts of Japan*, vol. 13, No. 188 (P-866), May 8, 1989 (JP 01-015765).

*Patent Abstracts of Japan*, vol. 13, No. 324 (P-903), Jul. 21, 1989 (JP 01-092776).

*Patent Abstracts of Japan*, vol. 8, No. 16 (M-270), Jan. 24, 1984 (JP 58-178038).

*Primary Examiner*—A. T. Grimley
*Assistant Examiner*—Sandra L. Brasé
*Attorney, Agent, or Firm*—Staas & Halsey

[57] ABSTRACT

A gear power transfer mechanism for driving a developing unit in an image forming apparatus wherein the developing unit is selectively located closely to and separated from a photoconductive drum unit in conjunction with opening and closing operations of a cover. This gear power transfer mechanism includes a first bevel gear provided on a rotation axis on a side of the photoconductive drum unit coupled with a drive motor, a second bevel gear always engaging with the first bevel gear, a third bevel gear provided on a rotating axis on a side of the developing unit, a fourth bevel gear always engaging with the third bevel gear and a rotation coupling device coupling the second bevel gear and fourth bevel gear. The rotation coupling device has a coupling structure which transfers rotation of the second bevel gear to the fourth bevel gear and allows movement of the fourth bevel gear relative to the second bevel gear when the developing unit is selectively located closely to and separated from the photoconductive drum unit.

8 Claims, 8 Drawing Sheets

IMAGE FORMING APPARATUS

This application is a continuation of application Ser. No. 07/870,775, filed Apr. 21, 1992, now abandoned, which was a continuation application Ser. No. 07/582,208, filed as PCT/JP90/00619, May 16, 1990, now abandoned.

BACKGROUND OF THE INVENTION

1. Field of the Invention

The present invention relates to an electrophotographic image forming apparatus which causes a developing unit to come close to or to be separated from a photoconductive drum unit in conjugation with the opening or closing operation of an upper frame, and, more particularly, to a gear power transfer mechanism for transmitting a rotating force of a drive motor to a side of the developing unit from a side of the photoconductive drum unit when the developing unit is caused to come close to the photoconductive drum unit.

2. Description of the Related Art

Image forming apparatus, such as laser printer or electronic copying machine are now widely used and these machines always require simplified operation procedures and stabilized printing quality.

Such image forming apparatus are structured so that an upper frame can be opened away from or closed toward a lower frame forming a boundary at an paper transfer path to reset a paper jam and to replace a developing unit and a photoconductive drum unit. Moreover, with such an opening or closing operation, the photoconductive drum unit provided within the upper frame is caused to come close to or to be separated from the developing unit and the power in the photoconductive drum unit is transferred to the developing unit via a power transmitting mechanism when the developing unit and photoconductive drum unit are caused to move close with each other.

FIG. 10A and FIG. 10B are structural diagrams schematically showing a typical example (Japanese unexamined patent Publication HEI 1-92776) of the image forming apparatus explained above.

This image forming apparatus divides the frame into an upper and a lower frame. The lower frame (hereinafter called a base) 1 is provided with a paper cassette setting part 11, a paper transfer path 12, a fixing unit 13 and a pick roller and a transfer roller (not illustrated). Meanwhile, the upper frame (hereinafter called a cover) 2 is provided with a photoconductive drum unit 3, a developing unit 4 and a link mechanism 5 and is rotatable around a rotating axis 14 relative to the base 1. At the dividing section of the base 1 and cover 2, a paper transfer path is formed.

Therefore, as shown in FIG. 10B, the cover 2 can be opened away from the base 1 at the boundary of the paper transfer path by rotation around the rotating axis 14.

The photoconductive drum unit 3 is fixed to the cover 2 and the developing unit 4 is swayably fixed to the cover 2. A mag roller (not illustrated) within a developing unit 41 can be moved closely to or separated from the photoconductive drum 31 through such swaying operation.

The link mechanism 5 sways the developing unit 4 in accordance with the closing and opening operation of cover 2, namely causes the developing unit 41 to come close to or separate from the photoconductive drum 31. For this purpose, the link mechanism 5 is composed of an L type rotatable arm 51, an L type transmitting arm 52 and a rotatable arm 53. The L type rotatable arm 51 has a guide hole 512 which engages with an engaging pin 511 provided on a base 1 at the one end thereof and rotates around the center axis 513 in accordance with the closing and opening operation of cover 2. The L type transmitting arm 52 couples the other end of the L type rotatable arm 51 and the one end of rotatable arm 53 to realize integrated operation of these arms. The rotatable arm 53 rotates around a rotating axis 531 and is provided, at the one end thereof, with a pushing mechanism 54 consisting of a plate spring to push the developing unit 4 toward the photoconductive drum unit 3.

Here, operations of link mechanism 5 will be explained.

First, the cover 2 shown in FIG. 10A is closed toward the base 1. In this case, the L type rotatable arm 51 of the link mechanism 5 is rotated around the rotating axis 513 simultaneously with depression in the direction of arrow mark A, thereby the transmitting arm 52 is pulled in the direction of arrow mark B and the rotatable arm 53 is driven to rotate counterclockwise around the rotating axis 531. Simultaneously, the pushing mechanism 54 integrated with the rotatable arm 53 is moved to the right side, pushing the developing unit 4 toward the photoconductive drum unit 3. As a result, the developing unit 41 and the photoconductive drum 31 are set in a closed condition. Since the developing unit 41 is provided with a pair of gap rollers 42 which are in contact with both end portions of an external circumference of the photoconductive drum 31, the magnetic roller and a photosensitive drum in the developing unit 41 are provided opposed with each other with a constant interval between them under such closed condition.

Next, the cover 2 shown in FIG. 10B is opened. Under this opened condition, the transmitting arm 52 of the link mechanism 2 is moved in the direction of arrow mark C and thereby a pushing force of the pushing mechanism 54 toward the developing unit 4 is eased. As a result, the developing unit 4 is separated from the photoconductive drum unit 3 with a recovery force of a spring (not illustrated) and, consequently, the photoconductive drum 31 is separated from the gap rollers 42.

Therefore, a large gap is generated, under this opened condition, between the developing unit 41 and the photoconductive drum 31 and, thereby a paper jam can be reset and replacement of the developing unit 41 and photoconductive drum 31 can be realized easily. Moreover, a surface of the photoconductive drum 31 can be protected from damage during the operations explained above.

As explained above, the image forming apparatus causes the developing unit 4 to come close to or to be separated from the photoconductive drum unit 3 in accordance with the opening and closing operations of the cover 2 and is also provided with a gear power transfer mechanism for transmitting the rotating force of a drive motor to a rotating part of developing unit 4 from the photoconductive drum unit 3 under the closed condition of these units explained above.

This gear power transfer mechanism 6 is composed, as shown in FIGS. 11A, 11B and FIG. 12, of a drive gear unit 62 coupled with the drive motor (not illustrated) on the side of photoconductive drum unit 3 and a driven gear unit 63 coupled with the rotating part of developing unit 41 (magnetic roller, developer agitating screw, etc.). The drive gear unit 62 is provided with three gears rotatably provided on a fixed substrate 61, namely a first intermediate gear 621 engaged with the drive motor, a second intermediate gear 622 always engaged with the first intermediate gear and a drive gear 623 always engaged with the second intermediate gear. The axis of first intermediate gear 621 is coupled with the drive mechanism of the photoconductive drum 31 and the second intermediate gear 622 is coupled with the rotating axis of a paper transfer roller (not illustrated).

On the other hand, the driven gear unit 63 is composed of a movable bracket 634 (hatched area in FIG. 12) provided movably in the direction of arrow mark to the fixed substrate 61 and three gears are rotatably provided on movable bracket 634. These three gears include a driven gear 631 engaging with the drive gear 623 on the side of photoconductive drum 31 when the developing unit 4 comes close to the photoconductive drum unit 3, a third intermediate gear 632 always engaging with the driven gear, and a fourth intermediate gear 633 always engaging with the third intermediate gear. The fourth intermediate gear 633 is provided with four pawls coupled with a coupling pawl gear on the side of developing unit 41 as shown in the figure. When these pawls couple, the magnetic roller and the developer agitating screw in the developing unit 41 are rotated. The gears explained above, although not limited thereto, may be manufactured through molding of the synthetic resin material.

Here, operations of this gear power transfer mechanism 6 will be explained.

First, the cover 2 shown in FIG. 11A is closed toward the base 1 and the developing unit 4 is moved toward the photoconductive drum unit 3. In this case, the driven gear 631 of the gear power transfer mechanism 6 engages with the drive gear 623 because both units are in the closed condition. As a result, a rotating force of the drive motor transmitted to the drive gear 623 through the first intermediate gear 621 and second intermediate gear 622 is further transferred sequentially to the driven gear 631, third intermediate gear 632 and fourth intermediate gear 633 from such drive gear 623 to rotate the magnetic roller within the developing unit 41. Therefore, the photoconductive drum 31 and developing unit 41 are driven by the single drive motor.

Next, the cover 2 shown in FIG. 11B is opened and thereby the developing unit 4 is separated from the photoconductive drum unit 3. In this case, the driven gear 631 of the gear power transfer mechanism 6 is separated from the drive gear 623 releasing the engagement and thereby the rotating force of drive motor is not transferred to the developing unit 41. Accordingly, the magnetic roller in the developing unit 41 is no longer rotated.

Meanwhile, in the image forming apparatus of the prior art explained above, the gap between the photoconductive drum 31 and developing unit 41 changes depending on a little deviation of a supporting axis of the gap rollers 42 and a rotating axis of photoconductive drum 31 which define such gap. Such change of gap has a large influence on the engagement between the drive gear 623 of the drive gear unit 62 and the driven gear 631 of driven gear unit 63. Namely, since positional relation between the drive gear unit 62 and driven gear unit 63 is determined with reference to the axis center of the gap rollers 42 of developing unit 4 and rotating center of the photoconductive drum 31. Even if the center positions are little deviated, adequate engagement between the drive gear 623 and driven gear 631 can no longer be attained.

Accordingly, here arises a problem wherein creak is generated between gears, for example, when engagement between the drive gear 623 and driven gear 631 becomes deep, or gear missing and gear skipping are generated when engagement becomes shallow, due to relative eccentricity of the rotating axes on the side of photoconductive drum unit 3 (rotating axes of the photoconductive drum 31 and drive gear) 623 and the driven axis axis on the side of developing unit 4 (supporting axis of gap rollers 42 and rotating axis of driven gear 631).

From such conditions, high level technique and longer processing time have been required for adjustment of the gap in order to attain adequate engagement between the drive gear 633 and driven gear 631. Thereby, the prior art has a disadvantage in that provision of gear power transfer mechanism 6 at the time of manufacturing the image forming apparatus and replacement of developing unit 4 and photoconductive drum 31 after manufacture of apparatus have been made ineffective. Therefore, it has also been difficult to prepare the gear power transfer mechanism 6 as a unit for maintenance work.

SUMMARY OF THE INVENTION

It is therefore a principal object of the present invention to provide a novel image forming apparatus which has solved disadvantages of the image forming apparatus of the prior art.

It is another object of the present invention to provide an improved gear power transfer mechanism which is always capable of transferring adequate rotating force to the rotating part of the developing unit.

It is a further object of the present invention to provide a gear power transfer mechanism which eliminates gap adjustment between gears, ensures easy assembling and maintenance and can easily be provided as a unit for maintenance work.

The present invention includes an image forming apparatus in which a developing unit is provided movably so that it can be moved closely to or separated from a photoconductive drum and a gear power transfer mechanism is provided so that a rotating axis on a side of a photoconductive drum unit, coupled with a drive motor, is coupled with a rotating axis on a side of the developing unit under a condition that the photoconductive drum and the developing unit are provided closely and, more paritucularly, in which such gear power transfer mechanism is structured as explained hereunder.

The gear power transfer mechanism according to the present invention comprises, as shown in FIG. 1, a first bevel gear 71 fixed to a rotating axis 624 on a side of a photoconductive drum unit, 3 a second bevel gear 72 provided so as to always engage with the first bevel gear, 71 a third bevel gear 81 fixed to a rotating axis 635 on a side of a developing unit 4, a fourth bevel gear 82 provided so as to always engage the third bevel gear, 81 and gear coupling means 91, engaging the second bevel gear 72 and the fourth bevel gear 82, for transferring the rotation of second bevel gear 72 to the fourth bevel gear 82 in an axis having a direction orthogonally crossing each rotating axis and for allowing the movement of fourth bevel gear 82 in the axial direction in conjunction with the movement of developing unit 41.

In short, the present invention has eliminated direct coupling between the drive gear and the driven gear which has been used in the prior art. Therefore, gap adjustment between the drive gear and the driven gear can be eliminated. Moreover, gear missing and gear skipping can be prevented and adequate motor power can always be transferred to a rotating part of the developing unit.

DESCRIPTION OF THE PREFERRED EMBODIMENTS

Embodiment 1

Figure 11A:
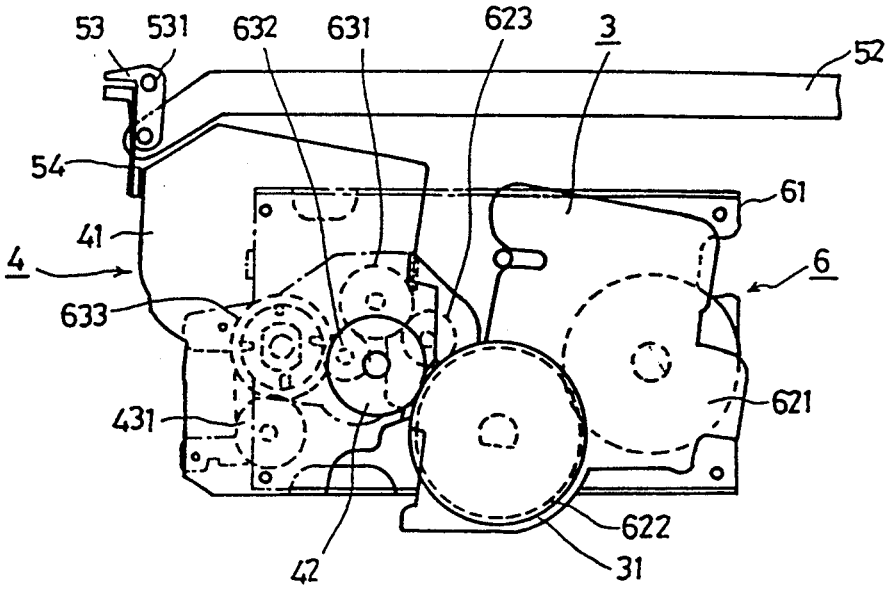
Fig.11A PRIOR ART
FIG. 11A is a front view of a gear power transfer mechanism of the prior art under the condition that the developing unit and photoconductive drum unit are in the closed condition.
Figure 11B:
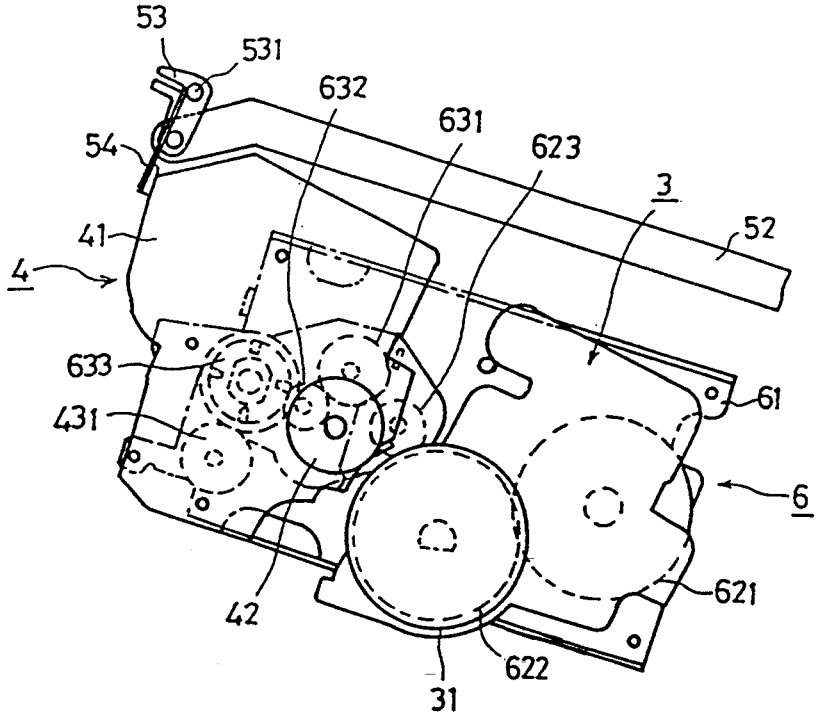
Fig.11B PRIOR ART
FIG. 11B is a front view of a gear power transfer mechansim of the prior art under the condition that the developing unit and photoconductive drum unit are separated from each other.
Figure 12:
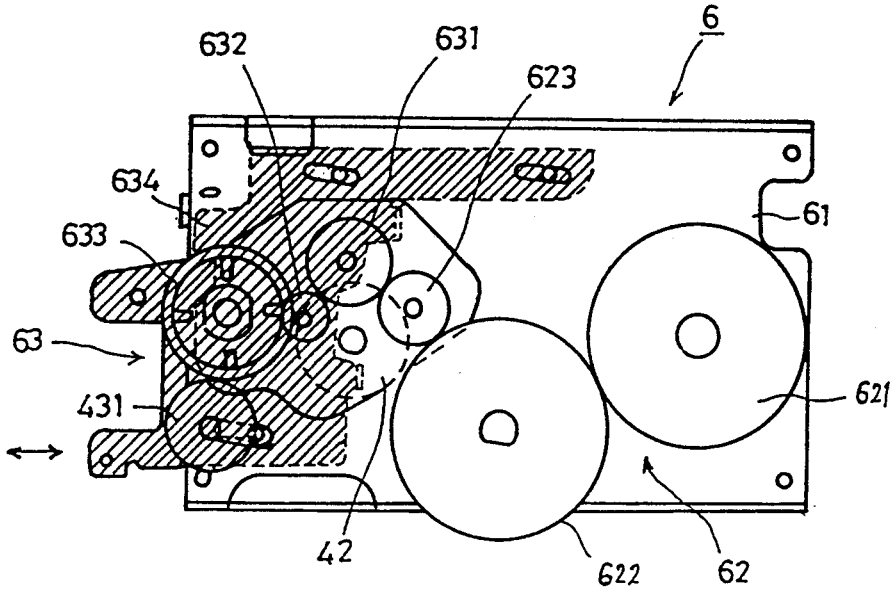
Fig. 12 PRIOR ART
FIG. 12 a rear view of a gear power transfer mechanism of the prior art under the condition that the developing unit and photosensitive drum unit are located closely.

An embodiment of the gear power transfer mechanism of the present invention will be explained with reference to FIG. 2 to FIG. 5. The elements like those of the prior art shown in FIG. 11 and FIG. 12 are designated by the like reference numerals.

Figure 1:
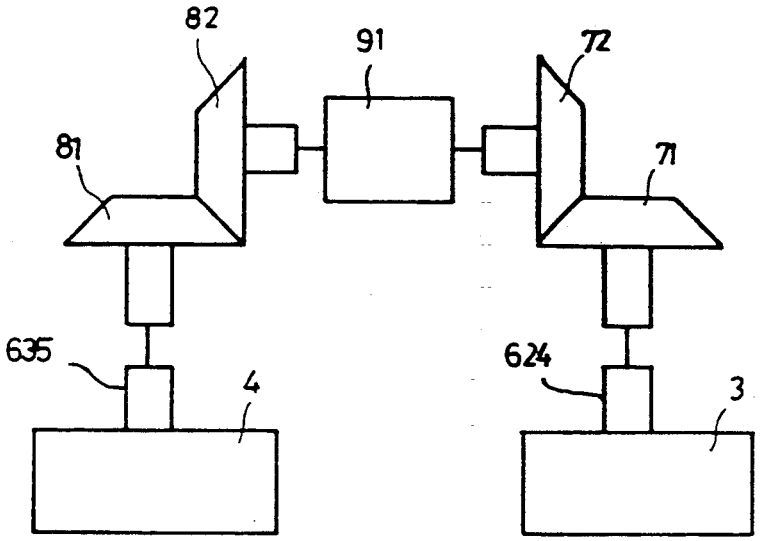
FIG. 1 is a diagram indicating principal structure of the gear power transfer mechanism in the image forming apparatus of the present invention.
Figure 2:
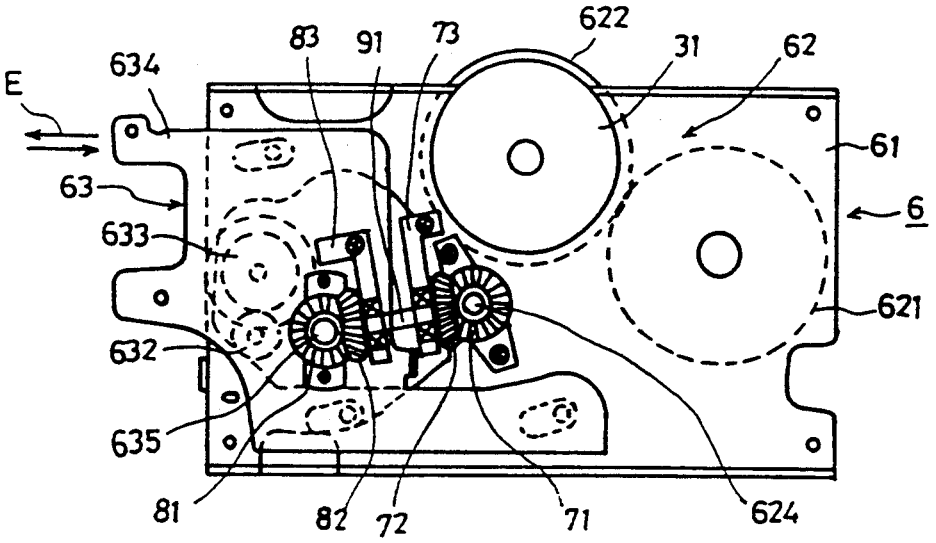
FIG. 2 is a rear view of the gear power transfer mechanism of an embodiment of the present invention.
Figure 3:
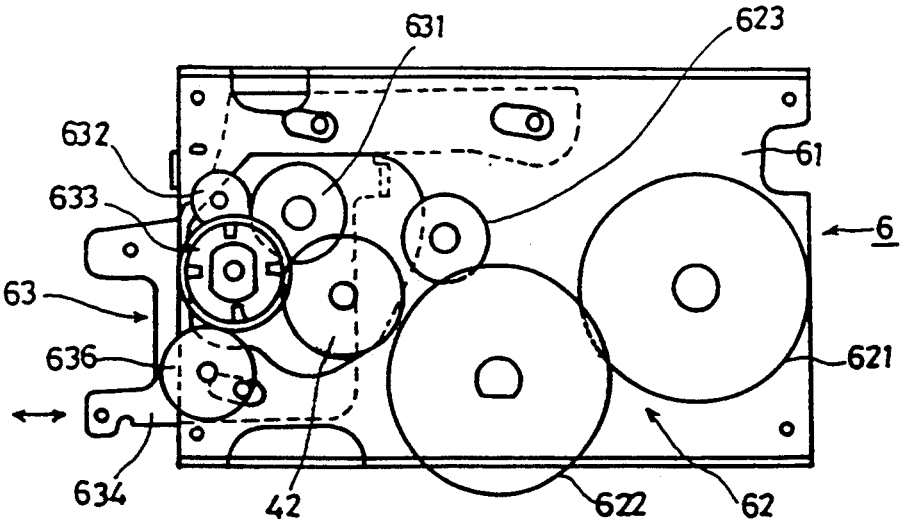
FIG. 3 is a front view of the gear power transfer mechanism of an embodiment of the present invention.
Figure 4:
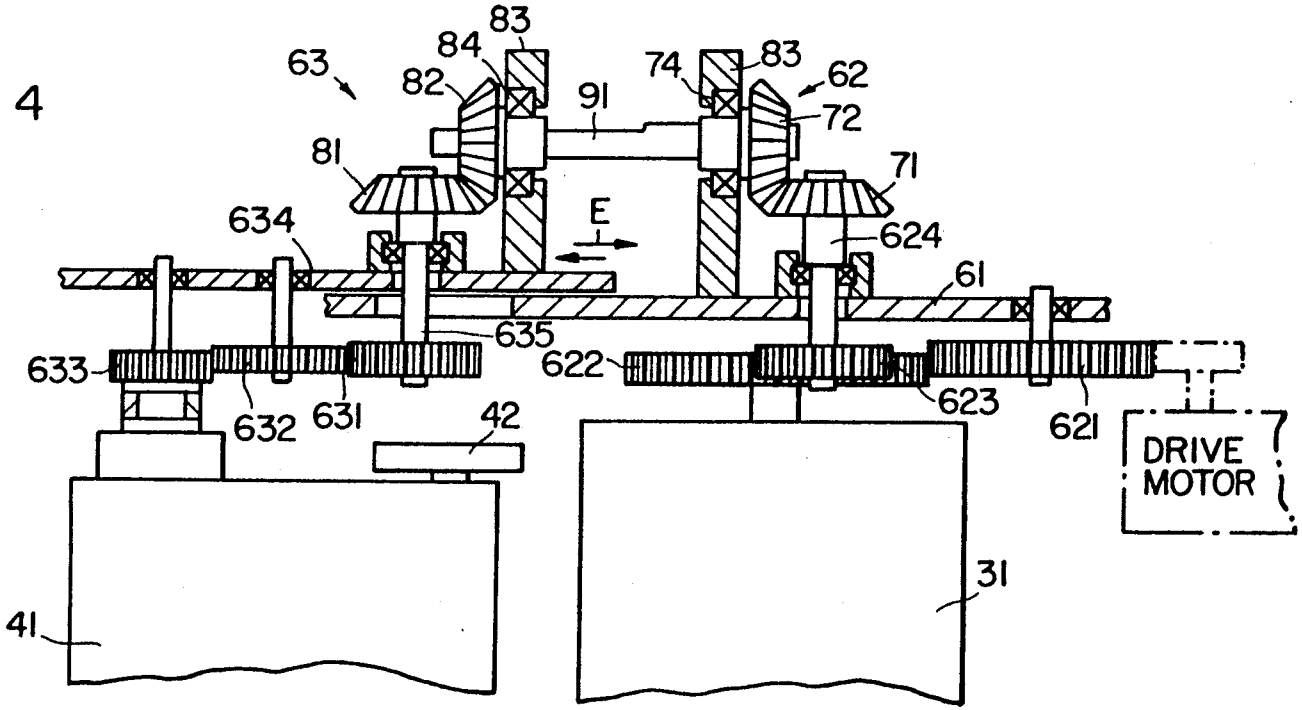
FIG. 4 is a sectional view indicating coupling structure between two pairs of bevel gears and a rotation transfer axis.
Figure 5:
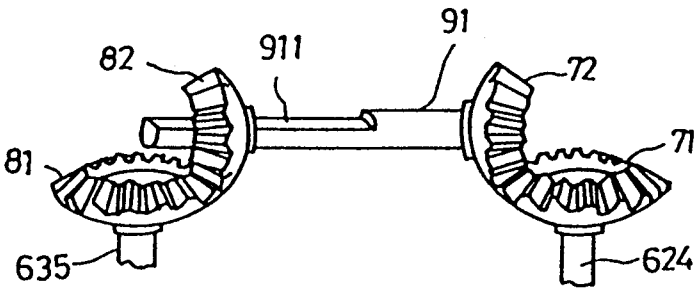
FIG. 5 is a perspective view of the essential portion of FIG. 4.

The main difference between the embodiment and the prior art is that two pairs of bevel gears 71, 72 and 81, 82 and single rotation transfer axis 91 are added. With the addition of such elements, the structure is partly modified. Namely, as shown in FIG. 4, the gap between the drive gear 623 on the side of the photoconductive drum unit and the driven gear 631 on the side of the developing unit is set to be wider than that of prior art. Also, the rotating axis 624 of the drive gear 623 is provided through the rear side of the fixed substrate 61, while the rotating axis 635 of the driver gear 631 is provided through the rear side of the fixed substrate 61 and the movable bracket 634. Each bevel gear is, for example, manufactured by the molding of synthetic resin materials.

The rotating axis 624 of drive gear 623 is coupled with the first bevel gear 71, which is always coupled with the second bevel gear 72. The second bevel gear 72 has a boss at a single side surface. This boss is rotatably supported through a bearing 74 of an L type supporting member 73 provided on the fixed substrate 61. Moreover, one end of rotation transfer axis 91 is fixed to an axis hole of the second bevel gear 72. The other end of rotation transfer axis 91 has a flat area 911 formed by cutting out a part of an external circumference and this flat area 911 is inserted into an axis hole of the fourth bevel gear 82 which will be explained later.

Accordingly, when the drive gear 623 is rotated by a drive motor, the rotating force thereof is sequentially transferred to the first bevel gear 71 and the second bevel gear 72 through the rotation axis 624 to rotate the rotation transfer axis 91.

On the other hand, the rotation axis 635 of driven gear 631 is coupled with the third bevel gear 81, which is always coupled with the fourth bevel gear 82. This fourth bevel gear 82 has a boss at a single side surface and this boss is rotatably supported through a bearing 84 by a L type supporting member 83 provided on the movable bracket 634. Moreover, the other end of the rotation transfer axis 91 is inserted into the axis hole of the fourth bevel gear 82. Under this insertion condition, the fourth bevel gear 82 is slidable along the rotation transfer axis 91 and it rotates together with the rotation transfer axis 91. The fourth bevel gear 82 can be rotated because this gear and rotation transfer axis 91 are tentatively coupled with each other by a contact force at the edge portion of flat area 911 provided at the other end of the rotation transfer axis 91.

Therefore, when the cover 2 is opened and the movable bracket 634 is thereby moved in the direction of arrow mark E together with the developing unit 4, the fourth bevel gear 82 slides on the rotation transfer axis 91 together with the bracket. Moreover when the photoconductive drum unit 3 and the developing unit 4 are ordinarily located closely, the rotating force of the drive motor transferred to the rotation transfer axis 91 is then transmitted to the third bevel gear 81 through the fourth bevel gear 82 and is then tranferred to the driven gear 631. As a result, a rotating part of the developing unit 4 is driven, like the prior art, by the drive motor on the side of photoconductive drum unit 3.

According to the embodiment of the present invention explained above, the drive gear on the side of the photoconductive drum unit is not directly coupled with the driven gear on the side of developing unit. Therefore, gap adjustment between such gears is unnecessary. Accordingly, the gear power transfer mechanism as a whole can be prepared as a unit element for maintenance work.

The coupling structure of the two pairs of bevel gears allows the following two types of modifications in addition to the embodiment explained above.

Embodiment 2

Figure 6:
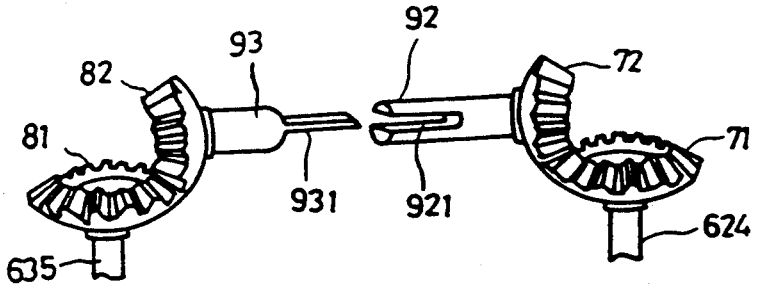
FIG. 6 is a perspective view of the essential portion indicating an example of modification of the coupling structure between two pairs of bevel gears and the rotation transfer axis.

As a first modification, two rotation transfer axes 92, 93 are used as shown in FIG. 6, and one of them is fixed to the second bevel gear 72 while the other is fixed to the fourth bevel gear 82. The free end of the first rotation transfer axis 92 fixed to the second bevel gear 72 is provided with a split groove 921, while the free end of the second rotation transfer axis 93 fixed to the fourth bevel gear 82 is provided with an engaging part 931 which may be fitted to the split groove 921. According to the coupling structure consisting of this split groove 921 and engaging part 931, arrangement the second rotation transfer axis 93 may be freely moved in the axial direction and rotates together with the first rotation transfer axis 92.

Accordingly, while the movable bracket 634 moves, the fourth bevel gear 82 can be moved together with the movable bracket 634 and rotation of the second bevel gear 72 can be transferred to the fourth bevel gear 82 under the condition that the developing unit 4 and photoconductive drum unit 3 are located adjacently. In the above structure, the coupling can further be stabilized by fixing a cylindrical portion surrounding the coupling portion of the first rotation transfer axis 92 and the second rotation transfer axis 93 to a side of any one of these axes.

Embodiment 3

Figure 7:
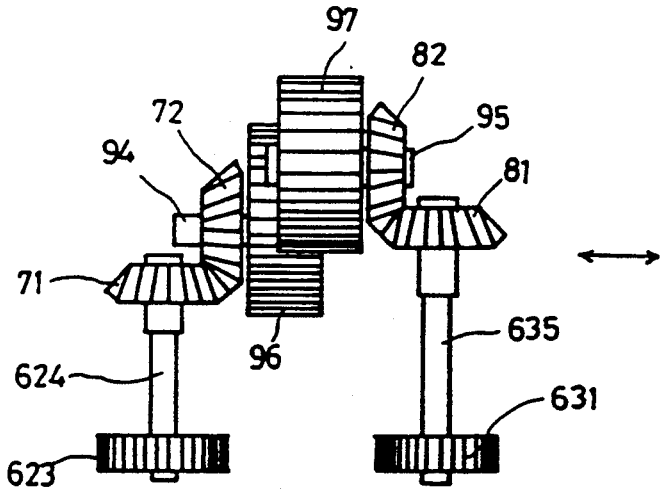
FIG. 7 is an outline diagram of another example of modification of the coupling structure of between two pairs of bevel gears and the rotation transfer axis.
Figure 8:
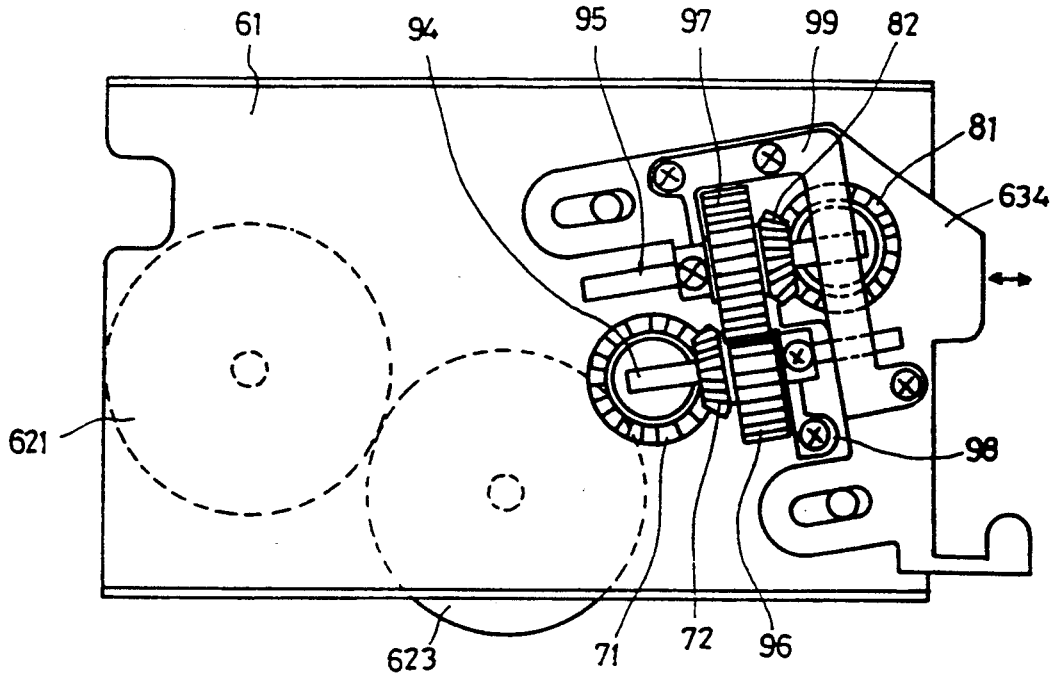
FIG. 8 is a rear view of gear power mechanism comprising a gear coupling structure of FIG. 7.
Figure 9:
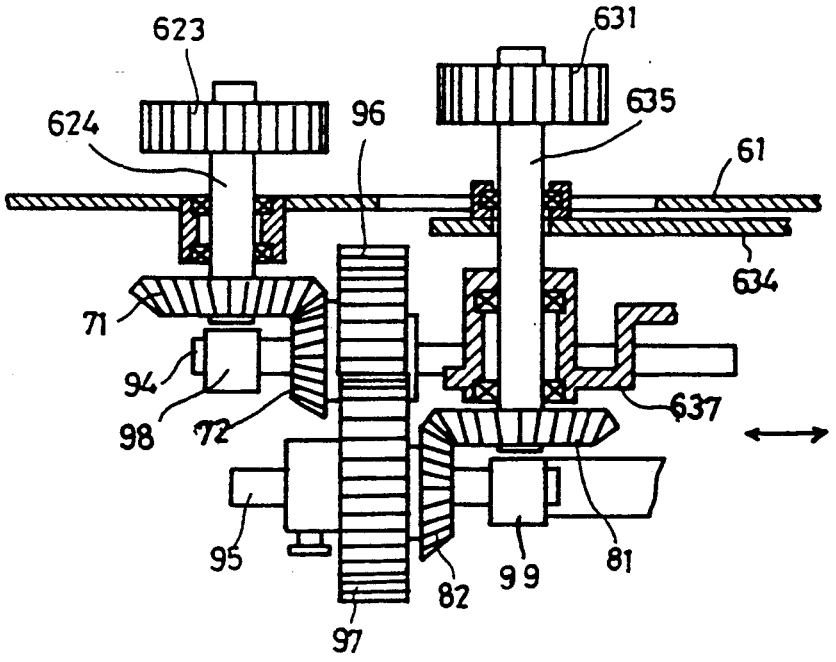
FIG. 9 is a sectional view of an essential portion of a gear coupling structure of FIG. 8.
Figure 10A:
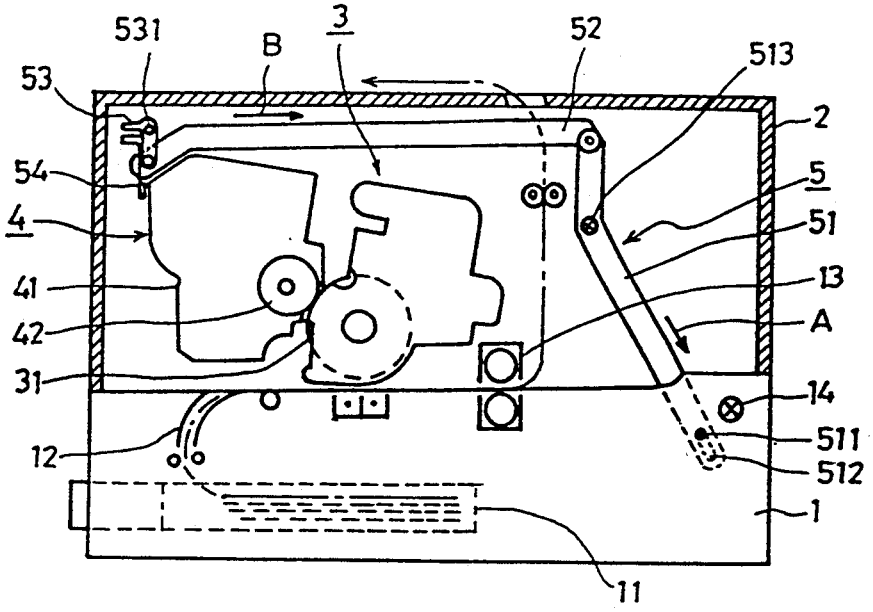
Fig.10A PRIOR ART
FIG. 10A is an outline of structure indicating the condition where the cover of image forming apparatus of the prior art is closed.
Figure 10B:
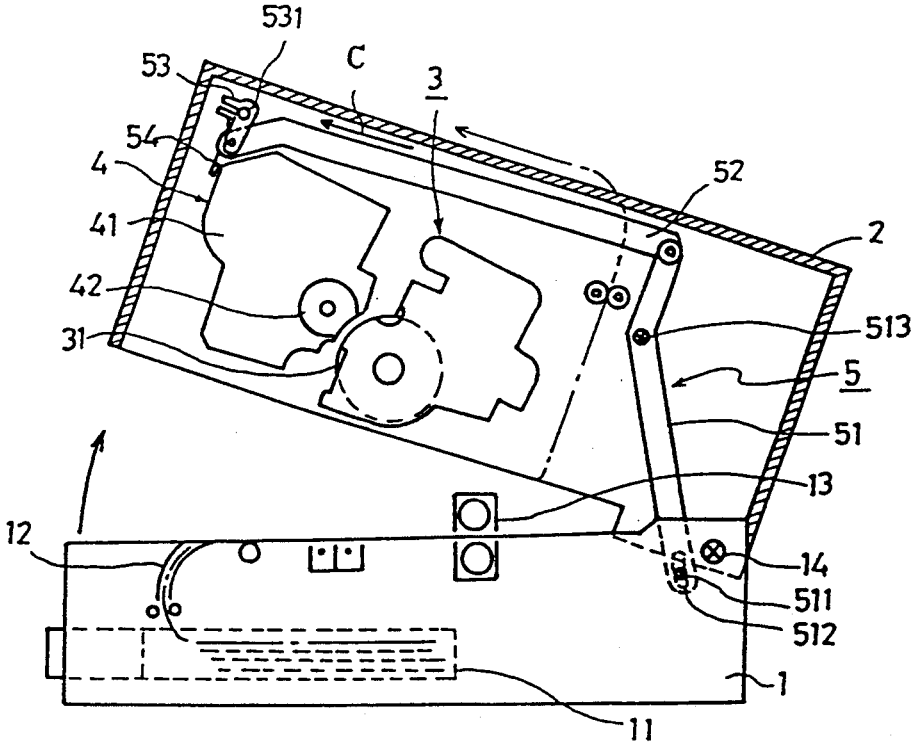
Fig 10B PRIOR ART
FIG. 10B is an outline of structure indicating the condition where the cover of image forming apparatus of the prior art is opened.

In another embodiment, as shown in FIG. 7 to FIG. 9, the two pairs of bevel gears are coupled with two rotation transfer axes 94, 95. However, this embodiment is different from the previous one in that, for example, an axis center of second bevel gear 72 is deviated in the upper and horizontal directions from an axis center of fourth bevel gear 82, the two rotation transfer axes 94, 95 to be fixed to respective axis holes are allocated in different position, and the free end of each rotation transfer axis is provided with a pair of flat gears 96, 97 which are always engaged with each other.

As shown in FIG. 7, the first flat gear 96 is fixed to the first rotation transfer axis 94 being fixed to the second bevel gear 72, while the second flat gear 97 is fixed to the second rotation transfer axis 95 being fixed to the fourth bevel gear 82. These two flat gears 96, 97 are provided in such a manner that they are always engaged with each other for transmission of rotation, and the second flat gear 97 is slidable with respect to the first flat gear 96 in order to realize movement of the fourth bevel gear 82. Therefore, each flat gear employs the gear structure where the height of each tooth is high and the number of teeth is small, and moreover the number of each of the teeth of bevel gears forming a pair is different. As shown in FIG. 8 and FIG. 9, the number of teeth of the first bevel gear 71 and third bevel gear 81 is set larger than the number of teeth of the second bevel gear 72 and fourth bevel gear 82. Thereby, a contact force (surface pressure) between tooth surfaces of a pair of flat gears becomes small so that the second flat gear 97 slides smoothly along the first flat gear 96 and transfer of driving force to the second flat gear 97 from the first flat gear 96 becomes more stable.

Moreover, in this modification, as shown in FIG. 8 and FIG. 9, the rotating axis 635 of the driven gear 631 is longer than the rotating axis 624 of the drive gear 623. Therefore, the third bevel gear 81 is located higher than the first bevel gear 71. A center area of the longer rotating axis 624 is supported by a bearing 637 for stabilizing rotation thereof. The movable bracket 634 is provided with a pair of supporting members 98, 99 in order to movably support the two rotation transfer axes 94, 95. The second bevel gear 72 and first flat gear 96 are fixed to the first rotation transfer axis 94, while the fourth bevel gear 82 and second flat gear 97 are fixed to the second rotation tranfer axis 95.

In this structure, when the movable bracket 634 is moved in the direction of the arrow mark, the second flat gear 97 slides on the first flat gear 96 together with the second rotation transfer axis 95 and moves in the same direction. Moreover, in the case wherein the photoconductive drum unit 3 and the developing unit 4 are located closely with each other, rotation of the first rotation transfer axis 94 is sequentially transmitted to the first flat gear 96 and second flat gear 97, to rotate the second rotation transfer axis 95.

Even in such embodiment, the rotating power can be transferred to the developing unit 4 from the side of photoconductive drum 31 like the above two embodiments. This embodiment has a peculiar effect, i.e., that high accuracy is not required for positioning of opposed second bevel gear 72 and fourth bevel gear 82.

While the preferred embodiments of the present invention have been described, the present invention also allows various other modifications within the scope of the claims.

What is claimed is:

1. An image forming apparatus having a movable developing unit which can be moved closely to and separated from a photoconductive drum of a photoconductive drum unit, and a gear power transfer mechanism which couples a first rotating axis on a side of the photoconductive drum unit and a second rotating axis on a side of the developing unit under a condition that the photoconductive drum and the developing unit are located closely, the first rotating axis being rotated by a drive motor, said gear power transfer mechanism comprising:

a first bevel gear fixed to the first rotating axis;

a second bevel gear provided so as to always engage with said first bevel gear;

a third bevel gear fixed to the second rotating axis;

a fourth bevel gear provided so as to always engage with said third bevel gear; and rotation coupling means for sequentially transferring rotation of the first rotating axis to the second rotating axis by coupling said second bevel gear and said fourth bevel gear so that rotation of said second bevel gear is transferred to said fourth bevel gear with an orthogonal axis orthogonally crossing said first rotating axis and said second rotating axis and so that movement of said fourth bevel gear relative to said second bevel gear in the axial direction of said orthogonal axis is allowed in conjunction with movement of the developing unit.

2. An image forming apparatus according to claim 1, wherein:

said second bevel gear and said fourth bevel gear rotate about a common axis; and said rotation coupling means includes a rotation transfer axis, one end of said rotation transfer axis is fixed to an axis of said second bevel gear while another end of said rotation transfer axis is provided with an engaging member which engages an axis hole of said fourth bevel gear so as to allow sliding of said engaging member relative to said fourth bevel gear and so as to couple rotation of said fourth bevel gear with rotation of said second bevel gear.

3. An image forming apparatus according to claim 1, wherein:

said second bevel gear and said fourth bevel gear rotate about a common axis; and said rotation coupling means includes a first rotation transfer axis being fixed at one end to an axis of said second bevel gear and having a first engaging member at another end, and a second rotation transfer axis being fixed at one end to an axis of said fourth bevel gear and having a second engaging member at another end, said first engaging member and said second engaging member engaging each other so as to allow relative sliding of said first and second rotation transfer axes and so as to couple rotation of said fourth bevel gear with rotation of said second bevel gear.

4. An image forming apparatus having a movable developing unit which can be moved closely to and separated from a photoconductive drum of a photoconductive drum unit coupled to a drive motor, and a gear power transfer mechanism which couples a first rotating axis on a side of the photoconductive drum unit and a second rotating axis on a side of the developing unit under a condition that the photoconductive drum and the developing unit are located closely, said gear power transfer mechanism comprising:

a first bevel gear fixed to the first rotating axis;

a second bevel gear provided so as to always engage with said first bevel gear;

a third bevel gear fixed to the second rotating axis;

a fourth bevel gear provided so as to always engage with said third bevel gear, said second bevel gear and said fourth bevel gear being rotatable about separate axes; and rotation coupling means for coupling said second bevel gear and said fourth bevel gear so that rotation of said second bevel gear is transferred to said fourth bevel gear with an orthogonal axis orthogonally crossing said first rotating axis and said second rotating axis and so that movement of said fourth bevel gear relative to said second bevel gear in the axial direction of said orthogonal axis is allowed in conjunction with movement of the developing unit, said rotation coupling means includes a first rotation transfer axis having one end fixed to an axis of said second bevel gear and another end fixed to a first flat gear, a second rotation transfer axis having one end fixed to an axis of said fourth bevel gear and having another end fixed to a second flat gear, and said second flat gear having teeth slidably engaged with teeth of said first flat gear to permit said movement of said fourth bevel gear relative to said second bevel gear in the axial direction of said orthogonal axis.

5. An image forming apparatus, comprising:

a photoconductive drum coupled to a first rotating axis rotated by a drive motor;

a developing unit coupled to a second rotating axis, said developing unit being selectively movable between a first position close to said photoconductive drum and a second position separated from said photoconductive drum; and power transfer means for sequentially transferring rotation of the first rotating axis to the second rotating axis by coupling said first rotating axis to said second rotating axis when said developing unit is in said first position and when said developing unit is in said second position.

6. An image forming apparatus, comprising:

a photoconductive drum coupled to a first rotating axis rotated by a drive motor;

a developing unit coupled to a second rotating axis, said developing unit having a changing positional relationship with said photoconductive drum;

a first bevel gear, associated with said photoconductive drum, fixed to said first rotating axis;

a second bevel gear, associated with said photoconductive drum, engaging said first bevel gear;

a third bevel gear, associated with said developing unit, fixed to said second rotating axis;

a fourth bevel gear, associated with said developing unit, engaging said third bevel gear; and rotation coupling means for sequentially transferring rotation of the first rotating axis to the second rotating axis by coupling said second bevel gear and said fourth bevel gear so that rotation of said second bevel gear is transferred to said fourth bevel gear during said changing positional relationship between said developing unit and said photoconductive drum.

7. An image forming apparatus, comprising:

a photoconductive drum coupled to a first rotating axis rotated by a drive motor, said photoconductive drum and said drive motor being located on a first side of a fixed substrate having first and second sides;

a developing unit coupled to a second rotating axis, said developing unit being selectively movable between a first position close to said photoconductive drum and a second position separated from said photoconductive drum, said developing unit being located on said first side of said substrate; and power transfer means, located on said second side of said fixed substrate, for sequentially transferring rotation of the first rotating axis to the second rotating axis by coupling said first rotating axis to said second rotating axis when said developing unit is in said first position and when said developing unit is in said second position.

8. An image forming apparatus, comprising:

a photoconductive drum coupled to a first rotating axis, said first rotating axis being fixed to a first flat gear in mesh with a second flat gear rotated by a drive motor;

a developing unit coupled to a second rotating axis, said developing unit having a changing positional relationship with said photoconductive drum;

a first bevel gear, associated with said photoconductive drum, fixed to said first rotating axis;

a second bevel gear, associated with said photoconductive drum, engaging said first bevel gear;

a third bevel gear, associated with said developing unit, fixed to said second rotating axis;

a fourth bevel gear, associated with said developing unit, engaging said third bevel gear; and rotation coupling means for sequentially transferring rotation of the first rotating axis to the second rotating axis by coupling said second bevel gear and said fourth bevel gear so that rotation of said second bevel gear is transferred to said fourth bevel gear during said changing positional relationship between said developing unit and said photoconductive drum.

* * * * *

UNITED STATES PATENT AND TRADEMARK OFFICE

CERTIFICATE OF CORRECTION

PATENT NO. : 5,319,418
DATED : June 7, 1994
INVENTOR(S) : Tetsuya Fujimoto, et. al.

It is certified that error appears in the above-indentified patent and that said Letters Patent is hereby corrected as shown below:

Column 1, line 23, change "machine"
to --machine,--.

Column 1, line 28, change "an" to --a--.

Column 1, line 60, change "mag" to
--magnetic--;
line 62, change "the" to --a--.

Column 2, line 5, change "the" to --a--;
line 39, change "2" to --5--.

Column 3, line 29, delete "the";
line 61, after "31" insert --,--.

UNITED STATES PATENT AND TRADEMARK OFFICE

CERTIFICATE OF CORRECTION

PATENT NO. : 5,319,418

DATED : June 7, 1994

INVENTOR(S) : Tetsuya Fujimoto, et. al.

It is certified that error appears in the above-indentified patent and that said Letters Patent is hereby corrected as shown below:

Column 4, line 11, change "gear) 623"

to --gear 623)--;

line 18, change "633" to --623--;

line 57, change "unit, 3" to

--unit 3,--;

line 58, delete "with";

line 61, change "gear, 81"

to --gear 81,--.

Column 5, line 47, after "12" insert --is--.

Column 6, line 3, change "driver"

to --driven--;

Column 6, line 53, change "tranferred" to

--transferred--.

UNITED STATES PATENT AND TRADEMARK OFFICE

CERTIFICATE OF CORRECTION

PATENT NO. : 5,319,418

DATED : June 7, 1994

INVENTOR(S) : Tetsuya Fujimoto, et. al.

It is certified that error appears in the above-indentified patent and that said Letters Patent is hereby corrected as shown below:

Column 7, line 14, change

"931, arrangement" to

--#931 arrangement--;

line 53, change "each of the teeth of" to

--teeth of each of the--;

Column 7, line 61, after "and" insert

--so that--.

Column 8, line 7, change "tranfer"

to --transfer--.

Signed and Sealed this

Twentieth Day of September, 1994

*Attest:*

*Attesting Officer*

BRUCE LEHMAN

*Commissioner of Patents and Trademarks*